United States Patent [19]

Swinburne

[11] Patent Number: 4,615,628

[45] Date of Patent: Oct. 7, 1986

[54] RIBBON CARTRIDGE WITH SELF-CONTAINED RATCHET AND DRIVE GEAR ASSEMBLY

[75] Inventor: Stephen G. Swinburne, Scarborough, Me.

[73] Assignee: Shape Inc., Biddeford, Me.

[21] Appl. No.: 719,152

[22] Filed: Apr. 2, 1985

[51] Int. Cl.[4] ..... B65H 75/00; B41J 35/28

[52] U.S. Cl. ..... 400/242; 400/207; 400/208.1; 400/232

[58] Field of Search ..... 400/191, 194, 196, 207, 400/208, 208.1, 242, 232

[56] References Cited

U.S. PATENT DOCUMENTS

| | | | |
|---|---|---|---|
| 2,325,885 | 8/1943 | Serrurier | 242/55 |
| 2,702,623 | 2/1955 | Pelton | 400/242 X |
| 2,733,021 | 1/1956 | Foster et al. | 242/71 |
| 3,385,535 | 5/1968 | Dodsworth | 242/67.1 |
| 3,409,113 | 11/1968 | McLean | 400/242 X |
| 3,432,021 | 3/1969 | Morelli | 400/242 X |
| 3,677,486 | 7/1972 | Findlay | 400/232 X |
| 3,923,141 | 12/1975 | Hengelhaupt | 400/232 X |
| 3,967,790 | 7/1976 | Hess | 242/67.2 |
| 4,132,485 | 1/1979 | Hess | 400/208 |
| 4,168,127 | 9/1979 | Hengelhaupt | 400/232 |
| 4,347,008 | 8/1982 | Jagodzinski et al. | 400/242 X |
| 4,434,950 | 3/1984 | Nunnerich et al. | 242/67.2 |
| 4,475,829 | 10/1984 | Goff, Jr. et al. | 400/232 |

FOREIGN PATENT DOCUMENTS

| | | | |
|---|---|---|---|
| 199679 | 12/1982 | Japan | 400/232 |
| 361905 | 2/1973 | U.S.S.R. | 400/232 |

OTHER PUBLICATIONS

IBM Tech. Disc. Bulletin, "Ribbon Feed Mechanism", Caudill et al., vol. 11, No. 12, May 1969, pp. 1754–1755.

*Primary Examiner*—Edgar S. Burr
*Assistant Examiner*—James R. McDaniel
*Attorney, Agent, or Firm*—Staas & Halsey

[57] ABSTRACT

A ribbon cartridge having a self-contained ratchet assembly and drive gear assembly. Three principal components are provided: a drive gear; a ratchet gear spool connected by a ring gear formed thereon to the drive gear; and a take-up spool having internal teeth which are rotatably mounted on a ratchet formed on the external diameter of the ratchet gear spool. The drive gear is driven by a simple printer motor at a constant speed, which, in turn, drives the ratchet gear spool at a constant speed. This action, in turn, drives the take-up spool through the flexible plastic ratchet at a speed that varies with the amount of ribbon accumulating on the take-up spool.

7 Claims, 4 Drawing Figures

RIBBON CARTRIDGE WITH SELF-CONTAINED RATCHET AND DRIVE GEAR ASSEMBLY

BACKGROUND OF THE INVENTION

This invention relates to ribbon cartridges, and more particularly, to a ribbon cartridge with a self-contained ratchet and drive gear assembly for winding used ribbon back into the cartridge.

Ribbon cartridges normally include a supply reel for holding a supply of fresh ribbon and a take-up reel to which used ribbon is transferred. A capstan located on an external apparatus, e.g., a printer, withdraws the ribbon from the supply reel, transports the ribbon at a constant rate past the print head of the printer, and retracts the ribbon back into the cartridge so that it may be wound on the take-up reel.

In an unused cartridge, the amount of ribbon wound on the take-up reel is small. However, as the ribbon is supplied from the supply reel, the amount of ribbon being wound on the take-up reel increases steadily. Eventually, all the ribbon is removed from the supply reel, after which the cartridge is discarded or, with some cartridges, the ribbon can be rewound on the supply reel for reuse.

In light of the above, means must be provided for driving the take-up reel as well as the capstan, such that the ribbon progressively and efficiently accumulates on the take-up reel, without snarling. Care must be taken, however, to ensure that the rate at which the ribbon is wound onto the take-up reel does not exceed the rate at which the ribbon is drawn into the cartridge by the capstan. If this latter rate is exceeded, an undesirable pulling force is exerted on the ribbon.

Efforts to date to design a simple, effective and economical drive assembly providing a constant rotational driving force for the capstan and a variable rotational driving force for the take-up reel have not been totally successful.

For example, most ribbon cartridges currently on the market utilize an O-ring drive assembly, wherein a flexible O-ring is stretched between projections formed on a drive gear and the take-up reel, which projections protrude through the cartridge cover. At the beginning of operation of such an O-ring drive assembly, the revolutions per minute of both the drive gear and the take-up reel are approximately the same. As the diameter of ribbon accumulating on the take-up reel increases, however, the take-up reel has to turn slower, which is accomplished through slippage at the interface of the projections and the O-ring. In theory then, near the end of operation of the cartridge, the drive gear turns many revolutions for every revolution of the take-up spool.

A major drawback of the O-ring drive assembly is that, as the O-ring slips, it generates unwanted debris. In addition, the O-ring has been known to actually break due to wearing through. Further, the physical characteristics of the O-ring are very critical in that the length, durometer, material composition, etc., must be very tightly controlled to assure that the O-ring slips just enough, but not too much. Accordingly, O-ring drive assembly design and manufacturing is necessarily expensive and time-consuming, without dependable operation being assured.

U.S. Pat. No. 3,967,790, issued to HESS, teaches another type of drive assembly for a ribbon cartridge. This patent teaches the use of a slippage gear clutch drive mechanism for providing a direct drive for the capstan and a releasable driving force for the take-up reel. When the pulling force generated by the increased accumulation of ribbon on the take-up reel exceeds the magnetic coupling force between a first gear and a second gear, the first gear slips relative to the second gear until the ribbon tension drops below a threshold value. When this occurs, the second gear is again rotated by the first gear, thereby driving the take-up reel. The magnitude of the threshold force for the slippage is primarily dependent on: the strength of the magnet; the magnetic permeability of a drive ring and an annular magnetic member used therein; the number and dimensional configuration of the teeth on the gears; and the air gap therebetween.

As can be seen, the drive assembly of the '790 patent is located outside of the cartridge. Therefore, the clutch mechanism in the drive assembly has to last for the life of a great many cartridges. Accordingly, the clutch mechanism must be built to be very durable and, therefore, manufacturing costs are high.

In light of the above-discussed prior art, a need still exists for a ribbon cartridge drive assembly which is capable of the most cost-efficient production and the highest operational reliability.

SUMMARY OF THE INVENTION

Accordingly, it is an object of the present invention to eliminate the need for the conventional, external O-ring drive assembly.

It is another object of the present invention to provide a ribbon cartridge drive assembly using a simple constant speed printer motor, rather than the conventional slipping clutch mechanism.

It is another object of the present invention to provide a ribbon cartridge with a self-contained ratchet and gear drive assembly.

It is another object of the present invention to provide a ribbon cartridge with a self-contained ratchet and gear drive assembly which can be manufactured at a lower price and which has a higher operational reliability than the conventional external O-ring drive assembly or slipping clutch mechanism.

Finally, it is an object of the present invention to provide a ribbon cartridge with a self-contained ratchet and drive gear assembly which costs little more to produce than a conventional ribbon cartridge, but whose operation is more reliable.

To achieve the foregoing and other objects of the present invention and in accordance with the purpose of the invention, there is provided a self-contained ratchet and drive gear assembly positioned within the base and cover of a ribbon cartridge. The assembly basically includes three components: a drive gear, a ratchet gear spool and a take-up spool. The drive gear is driven by a simple motor in the printer at constant speed, which, in turn, drives the ratchet gear spool at a constant speed. This action, in turn, drives the take-up spool via a flexible plastic ratchet formed on the ratchet gear spool at a speed that varies with the amount of ribbon accumulating on the take-up spool.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
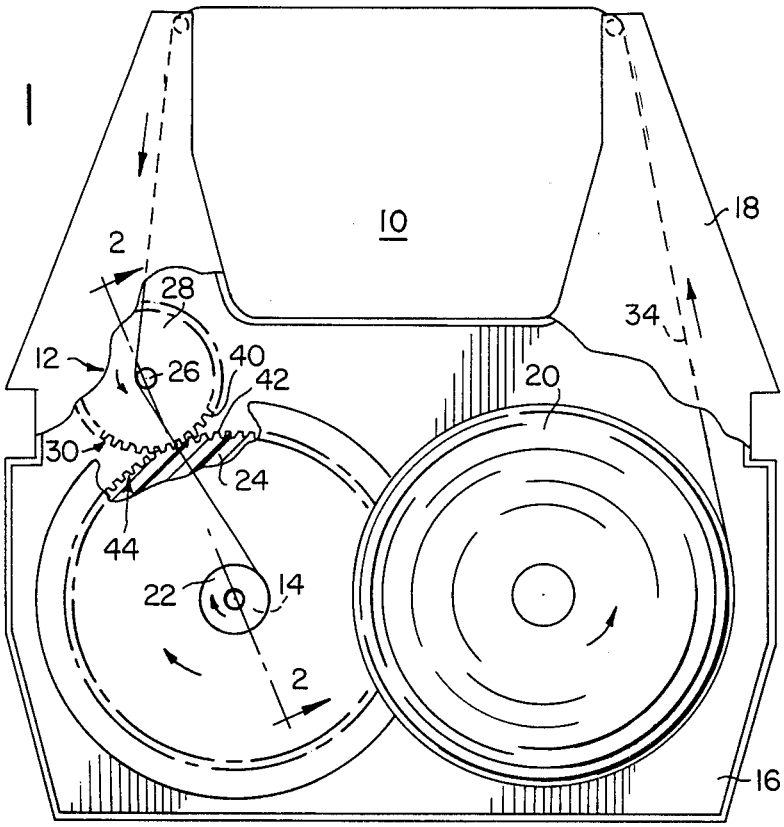
FIG. 1 is a top plan view of the ribbon cartridge of the present invention with the cover partially cut away, illustrating particularly the relationship of the take-up spool, the drive gear and the ratchet gear spool teeth.
Figure 2:
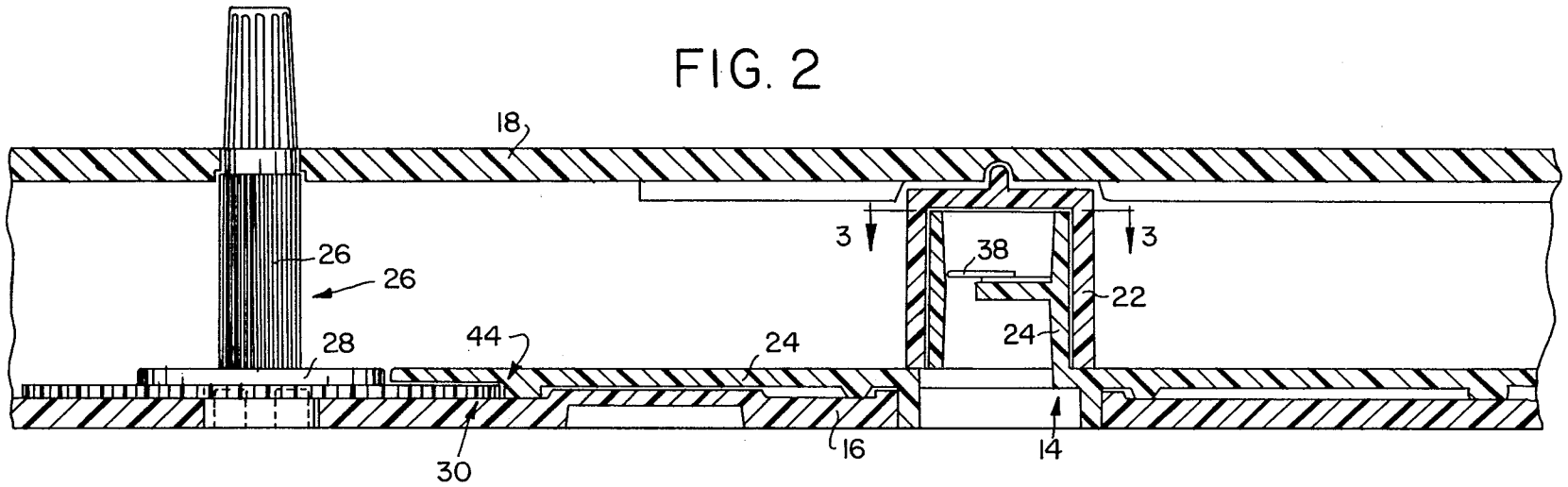
FIG. 2 is a side, cross-sectional view of the ribbon cartridge according to the present invention, illustrating particularly meshing of the drive gear with the ratchet gear spool teeth and the relationship of the flexible plastic ratchet with the take-up spool.

As shown in FIGS. 1 and 2, the ribbon cartridge of the present invention, indicated by reference numeral 10, includes generally a drive gear assembly 12 and a ratchet assembly 14, both of which are substantially self-contained within the base 16 and cover 18 of the cartridge 10. The ribbon cartridge 10 also comprises a supply reel 20 and a take-up spool 22 rotatably mounted on a molded ratchet gear spool 24.

The drive gear assembly 12 is a molded member comprising a projection 26 extending from a flange 28 and through the cover 18 of the ribbon cartridge 10. The flange 28 includes a drive gear 30 formed in the periphery thereof. Teeth 40 of the drive gear 30 mesh with teeth 42 of a ring gear 44 formed on the ratchet gear spool 24. Teeth 36 are formed on the internal diameter of the take-up spool 22 and mesh with a tooth or ratchet 32 formed on the ratchet gear spool 24. The ratchet 32 should be flexible and is preferably made of plastic.

Figure 3:
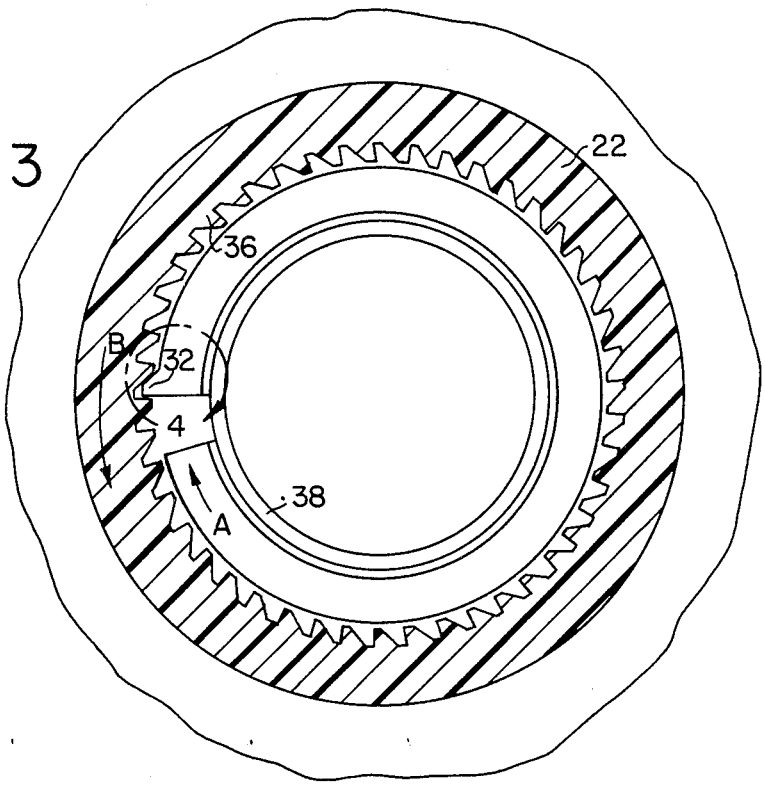
FIG. 3 is a top view of the ribbon cartridge of the present invention taken along line 3—3 of FIG. 2, illustrating particularly the flexible plastic ratchet meshing with the take-up spool teeth.
Figure 4:
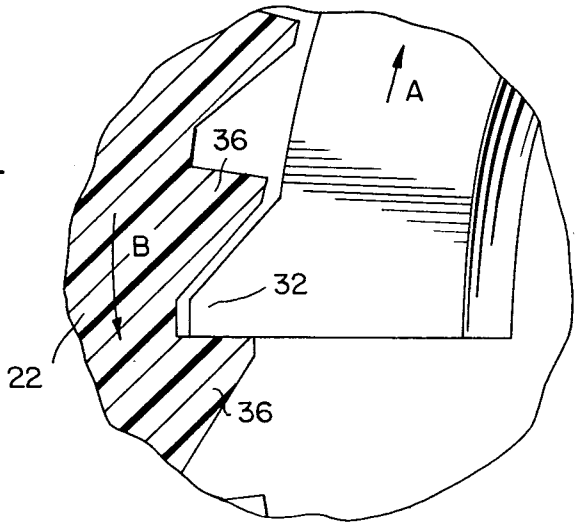
FIG. 4 is a detailed, top view of the ribbon cartridge of the present invention within line "4" of FIG. 3.

The above-described gear train creates the required slippage via the flexible plastic ratchet 32. More particularly, the drive gear 30 is driven by a simple printer motor (not shown) at a constant speed, which, in turn, drives the ratchet gear spool 24 and flexible plastic ratchet 32 at a constant speed in the direction indicated by arrow "A" (FIGS. 3 and 4). This action, in turn, drives the take-up spool 22 through the flexible plastic ratchet 32 at a speed that varies with the ribbon 34 accumulating on the take-up spool 22, i.e., the flexible plastic ratchet 32 is caused to slip relative to the take-up spool 22 in the direction indicated by arrow "B" (FIGS. 3 and 4).

More particularly, as shown in FIG. 3, the plurality of teeth 36 formed on the internal diameter of the take-up spool 22 mesh with the flexible plastic ratchet 32 formed on the ratchet gear spool 24. As the ratchet gear spool 24 rotates, the flexible plastic ratchet 32 rides in and out of the teeth 36 of the take-up spool 22. A hold back force is created on the take-up spool 22 by the ribbon 34 which is attached to the take-up spool 22. The ribbon 34 is wound on the take-up spool 22 at a constant speed. The amount of force required to slip from one tooth 36 to the next is determined by the geometry of this interface, wall thicknesses, etc. If the force is too great, the ribbon 34 will be pulled by the drive gear 30 too rapidly and may break. On the other hand, if the force is too little, the ribbon 34 will wind too loosely on the take-up spool 22 and the diameter of the ribbon 34 thereon will be too large to fit the ribbon cartridge 10. Accordingly, a split, circular, metal spring 38 can be inserted into the ratchet gear spool 24 behind the flexible plastic ratchet 32 to provide added control over the force exerted by the flexible plastic ratchet 32 against the take-up spool 22.

As seen from the above description, the ribbon cartridge 10 of the present invention provides an improved apparatus for addressing the variation in speed between the drive gear 30 and the take-up spool 22 in accordance with the amount of ribbon 34 accumulating on the take-up spool 22. This invention also provides for a cleaner looking ribbon cartridge 10, since the ratchet assembly 12 and drive gear assembly 14 are substantially self-contained within the ribbon cartridge 10.

This invention is a direct improvement over the conventional slipping clutch mechanism in that it can be made less durable and, accordingly, at lower cost. This ribbon cartridge 10 also has the advantages over the conventional O-ring drive system of eliminating excessive slippage characteristic of the O-ring, debris caused by the O-ring, breakdown due to the wearing of the O-ring, and the tighter manufacturing controls necessary for producing the O-ring ribbon cartridge drive system.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention and the appended claims and their equivalents.

I claim:

1. A ribbon cartridge for housing and transporting ribbon past an external apparatus, such as the print head of a printer having a drive motor, comprising:

(a) a base;

(b) a cover positioned on the base;

(c) a supply reel rotatably mounted between the base and the cover for supplying the ribbon;

(d) a take-up spool rotatably mounted between the base and cover for taking up the ribbon after it has been transported past the external apparatus;

(e) drive means rotatably mounted substantially between the base and cover for operative connection to the drive motor of the external apparatus and for transporting the ribbon from the supply reel to the take-up spool, the drive means including a projection having a circular flange and a drive gear formed on the flange, the projection extending perpendicularly through the cover.

wherein the take-up spool is rotatably mounted on a ratchet gear spool having a ring gear formed on the periphery thereof for meshing with the drive gear; and (f) means located between the base and cover for rotating the take-up spool at a rate different than the drive means.

2. The ribbon cartridge as recited in claim 1, wherein the ratchet gear spool comprises a ratchet formed thereon and the take-up spool comprises teeth formed on the internal diameter thereof for meshing with the ratchet.

3. The ribbon cartridge as recited in claim 2, wherein the ratchet gear spool further comprises a circular spring biased against the internal diameter thereof.

4. The ribbon cartridge as recited in claim 3, wherein the ratchet is a flexible plastic member.

5. A ribbon cartridge for housing and transporting ribbon past an external apparatus, such as the print head of a printer having a drive motor, comprising:

(a) a base;

(b) a cover positioned on the base;

(c) a supply reel rotatably mounted between the base and the cover for supplying the ribbon;

(d) a take-up spool rotatably mounted between the base and cover for taking up the ribbon after it has been transported past the external apparatus, the take-up spool having teeth formed on the internal diameter thereof;

(e) a drive gear rotatably mounted substantially between the base and cover for operative connection to the drive motor of the external apparatus and for transporting the ribbon from the supply reel to the take-up spool;

(f) a ratchet gear spool having a ring gear formed on the periphery thereof for meshing with the drive gear; and (g) a ratchet formed on the external diameter of the the ratchet gear spool which meshes with the teeth of the take-up spool;

wherein, when the drive gear moves at a first rate, the take-up spool moves at a second, different rate.

6. The ribbon cartridge as recited in claim 5, wherein the ratchet gear spool further comprises a circular spring biased against the internal diameter thereof.

7. The ribbon cartridge as recited in claim 6, wherein the ratchet is a flexible plastic member.

* * * * *